United States Patent [19]

Tratz et al.

[11] Patent Number: 5,050,512

[45] Date of Patent: Sep. 24, 1991

[54] COMBUSTION CHAMBER AND PROCESS FOR COMBUSTING AT LEAST PARTIALLY COMBUSTIBLE SUBSTANCES

[75] Inventors: Herbert Tratz, Ottensoos; Georg Lösel, Uttenreuth, both of Fed. Rep. of Germany

[73] Assignee: Siemens Aktiengesellschaft, Munich, Fed. Rep. of Germany

[21] Appl. No.: 552,812

[22] Filed: Jul. 16, 1990

[30] Foreign Application Priority Data

Jul. 19, 1989 [EP] European Pat. Off. ..... 89113285.4

[51] Int. Cl.[5] ..... F23G 5/00

[52] U.S. Cl. ..... 110/346; 110/165 A; 110/171; 110/204; 110/235; 110/259; 110/264

[58] Field of Search ..... 110/347, 264, 235, 265, 110/346, 259, 171, 204, 165 R, 165 A

[56] References Cited

U.S. PATENT DOCUMENTS

| | | | |
|---|---|---|---|
| 2,516,141 | 7/1950 | Newman et al. | 110/264 X |
| 2,707,444 | 5/1955 | Van Loon | 110/264 |
| 2,717,563 | 9/1955 | Sifrin | 110/264 X |
| 4,291,634 | 9/1981 | Bergsten et al. . | |
| 4,512,267 | 4/1985 | Cegielski Jr., et al. | 110/264 X |
| 4,745,869 | 5/1988 | Dilmore et al. | 110/347 |
| 4,873,930 | 10/1989 | Egense et al. | 110/264 X |
| 4,920,898 | 5/1990 | Solbes et al. | 110/347 X |

*Primary Examiner*—Edward G. Favors

*Attorney, Agent, or Firm*—Herbert L. Lerner; Laurence A. Greenberg

[57] ABSTRACT

A combustion chamber for combusting a substance includes a burner and at least three successively disposed parts including a primary chamber, a secondary chamber and an ash discharge chamber. The burner is associated with and conducts a first air flow to the primary chamber. The primary chamber has an inlet for conducting a second air flow for substoichiometric combustion of a substance to be combusted at a temperature below an ash softening point and without clinker flow. The secondary chamber has an inlet for conducting a third air flow for brief, intensive, complete combustion of the substance discharged from the primary chamber with clinker flow, and the secondary chamber has walls and a material lining the walls being resistant to fluid clinker. A process for combusting a substance being at least partially formed of combustible material includes feeding an air flow to the substance for substoichiometrically combusting the substance at a temperature below an ash softening point without clinker flow but with formation of a residue, and subsequently admixing a further air flow with the residue of the substoichiometric combustion for completely combusting the residue and forming flue gas and flowing ash. Prepared pyrolysis residue and incompletely burned gas may be discharged from a pyrolysis reactor as the at least partially combustible material made by low-temperature carbonization of trash in a system for thermal trash disposal.

41 Claims, 2 Drawing Sheets

COMBUSTION CHAMBER AND PROCESS FOR COMBUSTING AT LEAST PARTIALLY COMBUSTIBLE SUBSTANCES

The invention relates to a process for combusting an at least partially combustible substance and a burner-equipped combustion chamber, in particular a combustion chamber of a system for thermal waste disposal, having a pyrolysis reactor that converts trash into incompletely burned gas and essentially non-volatile pyrolysis residue; a discharge apparatus for the non-volatile pyrolysis residue being connected to the pyrolysis reactor and having an incompletely burned gas vent connection or neck for venting incompletely burned gas, and means for delivering the incompletely burned gas and prepared pyrolysis residue to the combustion chamber.

Previously known, uncooled combustion chambers have a fireproof coating over the entire inner surface thereof. Typically, the coating is masonry with fireproof fireclay bricks. Coating with a so-called tamping clay, or monolithic lining material, is typical. In such a combustion chamber, when fuel containing ashes is combusted, fluid ash that can attack the surfaces of the bricks or tamping clay is formed during operation. After a certain period of operation, repair or renovation of the fireclay bricks or tamping clay is accordingly necessary. For a combustion chamber, the intervals of operation between two repair periods can be prolonged by using particularly resistant fireclay bricks. However, fireclay bricks that are largely resistant to fluid ash are quite expensive.

Published European Application No. 0 302 310 A1 discloses a system for thermal trash disposal. With that system, trash is converted in a pyrolysis reactor into incompletely burned gas and essentially non-volatile pyrolysis residue. Connected to the pyrolysis reactor is a discharge apparatus for the non-volatile pyrolysis residue that has a vent neck or connection for venting incompletely burned gas. The incompletely burned gas and prepared pyrolysis residue, such as ground pyrolysis residue, reach a combustion chamber. Combustion takes place there, producing molten clinker. Flue gas is also produced, which is vented from the combustion chamber through a flue gas line. The molten clinker is also drained from the combustion chamber. After cooling down, it is then present in vitrified form.

The combustion chamber of the system, like other known combustion chambers, is lined with fireclay bricks or tamping clay. As with other combustion chambers, an expensive lining is present, so that the interval of operation between two required maintenance procedures for the combustion chamber is as long as possible.

It is accordingly an object of the invention to provide a combustion chamber and a process for combusting at least partially combustible substances, which overcome the hereinafore-mentioned disadvantages of the heretofore-known methods and devices of this general type and with which the combustion chamber can be produced at favorable cost and nevertheless only seldom needs maintenance. In particular, it should be possible to make the inner lining of the combustion chamber at favorable cost and to assure a long, uninterrupted operating time. The process for combusting at least partially combustible substances should also make do with an economical inner liner of a combustion chamber.

With the foregoing and other objects in view there is provided, in accordance with the invention, a combustion chamber for combusting a substance (or material), comprising a burner; and at least three successively disposed parts including a primary chamber, a secondary chamber and an ash discharge chamber; the burner being associated with and conducting a first air flow (primary air) to the primary chamber; the primary chamber having an inlet for conducting a second air flow (secondary air) for substoichiometric combustion of a substance to be combusted at a temperature below an ash softening point and without clinker flow or flux; and the secondary chamber having an inlet for conducting a third air flow (tertiary air) for brief, intensive, complete combustion of the substance discharged from the primary chamber with clinker flow or flux, and the secondary chamber having walls and a material lining the walls being resistant to fluid clinker.

In accordance with another feature of the invention, there is provided a system for thermal trash disposal including a pyrolysis reactor for converting trash into incompletely burned gas and essentially non-volatile pyrolysis residue, and a discharge apparatus being connected to the pyrolysis reactor for the non-volatile pyrolysis residue and having a gas vent connection or neck for venting incompletely burned gas. The combustion chamber receives the incompletely burned gas and prepared pyrolysis residue.

In accordance with a further feature of the invention, the ash discharge chamber has a bottom in which an ash outlet hole is formed and also has a flue gas vent opening.

The primary chamber is constructed for substoichiometric combustion. In order for the combustion to remain always substoichiometric, an air deficiency must always prevail in the primary chamber.

In accordance with an added feature of the invention, there are provided inlets for two separate air flows in the primary chamber, the flows being the primary air and the secondary air. In this way, the required air flow can be available at all points of the primary chamber, without there being too much air in one part of the primary chamber, for instance in the upper region. The temperature in the primary chamber does not drop below the ash softening point, which is dictated by the substoichiometric combustion. The ash softening point for a certain type of ash is a temperature at which by definition a predetermined deformation and adhesive capability ensue. Since the ash softening point in the primary chamber is not exceeded, fluid ash or clinker cannot reach the inner liner of the primary chamber. This makes it unnecessary to line the primary chamber with expensive fireclay bricks that are resistant to fluid ash or clinker, or with correspondingly resistant tamping clay.

In accordance with an additional feature of the invention, the secondary chamber following the primary chamber has an inlet for tertiary air. Through the use of this tertiary air, an air excess is established in the secondary chamber, which assures a brief, intensive and complete combustion. In this process the temperature exceeds the ash flow point, and the result is clinker flux on the inner surface of the secondary chamber. The ash flow point for a specific type of ash is a temperature at which the viscosity is so low that the ash flows.

Therefore, in accordance with yet another feature of the invention, the secondary chamber according to the invention is coated with heat-resistant material that is resistant to fluid clinker. This material is more expensive than the material used for coating the primary chamber. However, the system according to the invention requires the expensive material only for coating part of the combustion chamber, namely the secondary chamber. Accordingly, not as much expensive material is needed.

In accordance with yet a further feature of the invention, the ash discharge chamber adjoins the secondary chamber, an ash outlet hole is formed in the bottom of the ash discharge chamber, only the bottom of the ash discharge chamber that comes into contact with fluid ash or clinker is coated with material resistant to fluid clinker, and the ash discharge chamber has a flue gas vent opening, to which a flue gas conduit that leads to a chimney may be connected.

If the combustion chamber according to the invention is used in a system for thermal trash disposal, such as a so-called low-temperature carbonization incinerator, prepared pyrolysis residue is combusted along with incompletely burned gas in the combustion chamber. Flue gas and fluid ash or clinker remain, which can be further processed in a water bath to make granulated fused material.

An advantage attained with the combustion chamber according to the invention is attained that a majority of the combustion chamber, that is the primary chamber, does not need an expensive lining. Only a small part of the combustion chamber, namely the secondary chamber, requires a lining which is resistant to fluid clinker. The combustion chamber according to the invention can be made economically and assures a long, unimpeded operating time.

In accordance with yet an added feature of the invention, the walls of the secondary chamber are cooled. As a result, an expensive coating of the interior of the secondary chamber for protecting against fluid ash and clinker can also be dispensed with. A long, unimpeded operating time is assured with an economical coating. A coating can be selected that is less expensive than a coating that would be necessary in an uncooled chamber, in which fluid ash or clinker flows.

In accordance with yet an additional feature of the invention, the inlet for the second air flow (secondary air) is located in the burner. In accordance with again another feature of the invention, the inlet for the secondary air is located in the upper portion of the primary chamber, laterally beside the connection for the burner. In accordance with again a further feature of the invention, a plurality of inlets for secondary air are disposed on the primary chamber, over the entire length thereof. This has the particular advantage of establishing the precise air concentration that assures substoichiometric combustion at a temperature below the ash softening point everywhere in the entire primary chamber.

The delivery of air into the primary chamber should be selected in such a way that on one hand the temperature of the ash softening point is not exceeded and on the other hand the substoichiometric combustion in the entire primary chamber is always maintained. This is assured particularly by providing that in addition to the primary air, secondary air can reach the primary chamber, particularly at the especially selected points. Thus the air flow can be adjusted optimally at every point of the primary chamber.

In accordance with again a further feature of the invention, one inlet or a plurality of inlets for the secondary air are aligned obliquely in the primary chamber, or in other words with a tangential component relative to the wall of the primary chamber. This generates an eddy in the medium located in the primary chamber that is propagated from the primary chamber on into the secondary chamber.

In the primary chamber, the medium is mixed by this addition of secondary air. The weak spin produced at the inlet to the secondary chamber promotes the formation of a spin in the secondary chamber.

In accordance with again an added feature of the invention, inlets for the secondary air are disposed in parallel planes one below the other in the primary chamber.

In accordance with again an additional feature of the invention, two or more inlets for the tertiary air are disposed in the secondary chamber, in parallel planes one under the other. The combustion in the primary chamber, and in the secondary chamber as well, can be controlled by this delivery of air in a plurality of planes.

In accordance with still another feature of the invention, the inlets for air discharge into indentations formed in the inner wall of the primary chamber and/or the secondary chamber. This protects the discharge points from the material located in the combustion chamber.

In accordance with still a further feature of the invention, there is provided an eave-like protrusion being disposed above an inlet on the inner wall of the combustion chamber. This is done in order to protect a discharge point.

In accordance with still an added feature of the invention, the primary chamber is subdivided into partial combustion chambers being connected in series. In accordance with still an additional feature of the invention, the inlets for the second air flow are disposed in each partial combustion chamber, in the upper portion thereof, or in other words in the flow direction at the inlet to the partial combustion chamber. By subdividing the primary chamber into partial combustion chambers and supplying air into each of these partial combustion chambers, an optimal delivery of air into the primary chamber and optimal mixing of the medium in the primary chamber are attained.

In accordance with another feature of the invention, the inlet for tertiary air into the secondary chamber is obliquely aligned, or in other words with a tangential component relative to the wall of the secondary chamber. As a result, a spin that forces the heavy parts of the medium in the secondary chamber toward the wall is generated directly in the secondary chamber. There, fluid ash is deposited on the wall and flows along the wall to the outlet opening of the secondary chamber. From there, the fluid ash reaches the ash discharge chamber. The effect of the spin generated in the secondary chamber is markedly improved if a spin has already been generated in the primary chamber. The advantage of generating a spin in the medium that is located in the combustion chamber is that fluid ash and clinker can be separated quickly and reliably from flue gas and from other substances as well.

In accordance with a further feature of the invention, like the primary chamber, the secondary chamber can also be subdivided into successively connected partial combustion chambers. Correspondingly, in accordance with an added feature of the invention, there are provided inlets for the third air flow in each partial combustion chamber, for instance, of the secondary chamber in the upper portion thereof, or in other words at the inlet of the partial combustion chamber in the flow direction. With the subdivision of the secondary chamber into partial combustion chambers as well and with the delivery of air into each of these partial combustion chambers, accurate control of the combustion in the secondary chamber is possible. Improved mixing of the medium in the secondary chamber is attained as well.

In accordance with an additional feature of the invention, the walls of the secondary chamber are covered from the inside with bricks, for instance. These bricks include a material that is resistant and is not attacked by clinker and ash. In accordance with yet another feature of the invention, the walls of the secondary chamber are coated from the inside with a tamping clay that has corresponding properties. Since only the secondary chamber needs to be equipped with expensive brick or tamping clays, this has a cost advantage over a combustion chamber that must be lined completely with expensive bricks or tamping clays.

In accordance with yet a further feature of the invention, these walls are cooled. This is done in order to make the walls of the secondary chamber even less expensive. To this end, in accordance with yet an added feature of the invention, the walls of the secondary chamber contain cooling conduits, for instance, which hold a coolant such as water or air. As a result of this continuous cooling of the secondary chamber walls from the outside, pronounced overheating of the inner surfaces of the walls that are moistened with the fluid ash or clinker is prevented. Consequently, inexpensive linings, of the kind already used in the primary chamber, can be used even in the secondary chamber. As a result of the cooling, a thin, solid layer of clinker forms on the surface of the lining, and a liquid film of clinker forms on it, toward the inside. The solid clinker layer protects the material of the lining located below it from attack by the fluid clinker. Accordingly, an expensive material that is resistant to clinker flux is unnecessary for the lining of the secondary chamber.

In accordance with yet an additional feature of the invention, fly ash is delivered to the primary chamber or the secondary chamber or the ash discharge chamber. This delivery can be made through special delivery openings, or through the burner or together with secondary air or tertiary air. If the fly ash can easily bond into a clinker bath because of its properties,, then it is especially advantageous to supply the fly ash directly to the ash discharge chamber. In this way, the fly ash is bound into the clinker.

In accordance with again another feature of the invention, the ash discharge chamber is wider than the outlet of the secondary chamber. As a result, the clinker or fluid ash removed from the secondary chamber does not reach the side walls of the ash discharge chamber. Therefore, in accordance with again a further feature of the invention, only the bottom of the ash discharge chamber is coated with material resistant to fluid clinker. In accordance with again an added feature of the invention, the material is costly brick or fireclays, or inexpensive brick or fireclays is provided with a cooling apparatus present in the bottom of the ash discharge chamber. In accordance with again an additional feature of the invention, the bottom of the ash discharge chamber contains cooling conduits of the cooling apparatus for receiving a coolant, in particular water or air.

In accordance with still another feature of the invention, the bottom of the ash discharge chamber extends horizontally, and as a result a layer of clinker that protects the bottom against erosion can form around the ash outlet hole during the cooling.

In accordance with still a further feature of the invention, the outlet of the secondary chamber is surrounded in the secondary chamber with a bead or ring having a drain point at one side, remote from the flue gas vent opening. To this end, the height of this ring, as measured from an imaginary horizontal plane, is less than otherwise at a point remote from the flue gas vent neck or connection of the ash discharge chamber. The result is a channel that extends around the outlet of the secondary chamber. During operation of the combustion chamber, this channel fills with fluid ash or clinker. At the lowermost point of the bead or ring, relative to a horizontal plane, the clinker flows in a stream out of the secondary chamber into the ash discharge chamber as soon as the channel is full. Since the lowermost point of the bead or ring is located at a point remote or facing away from the flue gas vent neck or opening of the ash discharge chamber, all of the fluid clinker flows in only a single stream into the ash discharge chamber. Accordingly, the bead or ring produces the advantage of ensuring that only a stream of ash that is not intersected by outflowing flue gas is produced from the secondary chamber into the ash discharge chamber. Thus the outflow of ash is not impeded by the flow of flue gas. If fluid ash and flue gas were both to flow uncontrolled out of the wide outlet from the secondary chamber, the result would be a possible mixing of flue gas and clinker in the ash discharge chamber. Instead of reaching the ash outlet hole, small amounts of clinker would be vented along with the flue gas. This is prevented by means of the bead or ring in the secondary chamber.

In accordance with still an added feature of the invention, there is provided an ash catcher grate in the flue gas vent neck or opening of the ash discharge chamber. This has the advantage of permitting fewer ash particles to reach the flue gas conduit. Such particles would soil the heat exchanger surfaces present in the flue gas line.

In accordance with still an additional feature of the invention, there is provided a reheating burner in the ash discharge chamber. It is used in the event that the fluid clinker or ash coming from the secondary chamber has poor flow properties. In that case the clinker is reheated in the ash discharge chamber, so that it reaches the ash outlet hole and exits there. If the clinker or ash is sufficiently flowable, the reheating burner stays switched off. In accordance with another feature of the invention, the reheating burner is fed with an outside fuel. However, it can also be fed with incompletely burned gas originating in a pyrolysis reactor. This economizes on outside fuel.

A particular advantage attained with the combustion chamber according to the invention is that long operating intervals without maintenance work or repair work on the combustion chamber are attainable with an inexpensive structure of the combustion chamber.

With the objects of the invention in view, there is also provided a process for combusting a substance being at least partially formed of combustible material, such as prepared pyrolysis residue and incompletely burned gas formed by low-temperature carbonization of trash, which comprises feeding an air flow (primary air and secondary air) to the substance for substoichiometrically combusting the substance at a temperature below an ash softening point without clinker flow or flux but with formation of a residue; and subsequently admixing a further air flow (tertiary air) with the residue of the substoichiometric combustion for completely combusting the residue and forming flue gas and flowing ash.

In order to perform this process, a combustion chamber that can be manufactured relatively inexpensively and at the same time is resistant and requires little maintenance can be used. The combustion chamber described above is particularly suitable.

In accordance with another mode of the invention, there is provided a process which comprises generating a spin in the material to be handled, and in particular in the residue of the substoichiometric combustion. As a result, the fluid ash that forms is discharged to the outside and can flow downward along a container wall, such as the combustion chamber wall. This improves the separation of flue gas and fluid ash.

In accordance with a further mode of the invention, there is provided a process which comprises admixing fly ash with the material to be handled or with the residue of the substoichiometric combustion. This fly ash can be derived from the process of the invention and accordingly is recirculated. However, fly ash can also be admixed with the still-flowing ash or clinker. The fly ash is thus advantageously bound entirely or partly into later-solidified granulated clinker.

In accordance with an added mode of the invention, there is provided a process which comprises reheating the fluid ash, once it has been formed, to prevent premature solidification. This step provides an improved flow of clinker out of the ash discharge chamber of the combustion chamber.

In accordance with a concomitant mode of the invention, there is provided a process which comprises cooling the flue gas produced in a heat exchanger, and feeding it into the combustion chamber along with the combustion air, in the burner or in separate delivery points. As a result, the temperature required for the process can be adjusted at every point of the combustion chamber.

With the system and the process according to the invention, an advantage is attained which is that the substance to be treated, which in particular is pyrolysis residue and incompletely burned gas from a low-temperature carbonization process, can be reliably broken down into fluid ash and flue gas in a combustion chamber that can be manufactured at favorable cost and requires little expense for maintenance and repair. Other features which are considered as characteristic for the invention are set forth in the appended claims.

Although the invention is illustrated and described herein as embodied in a combustion chamber and a process for combusting at least partially combustible substances, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
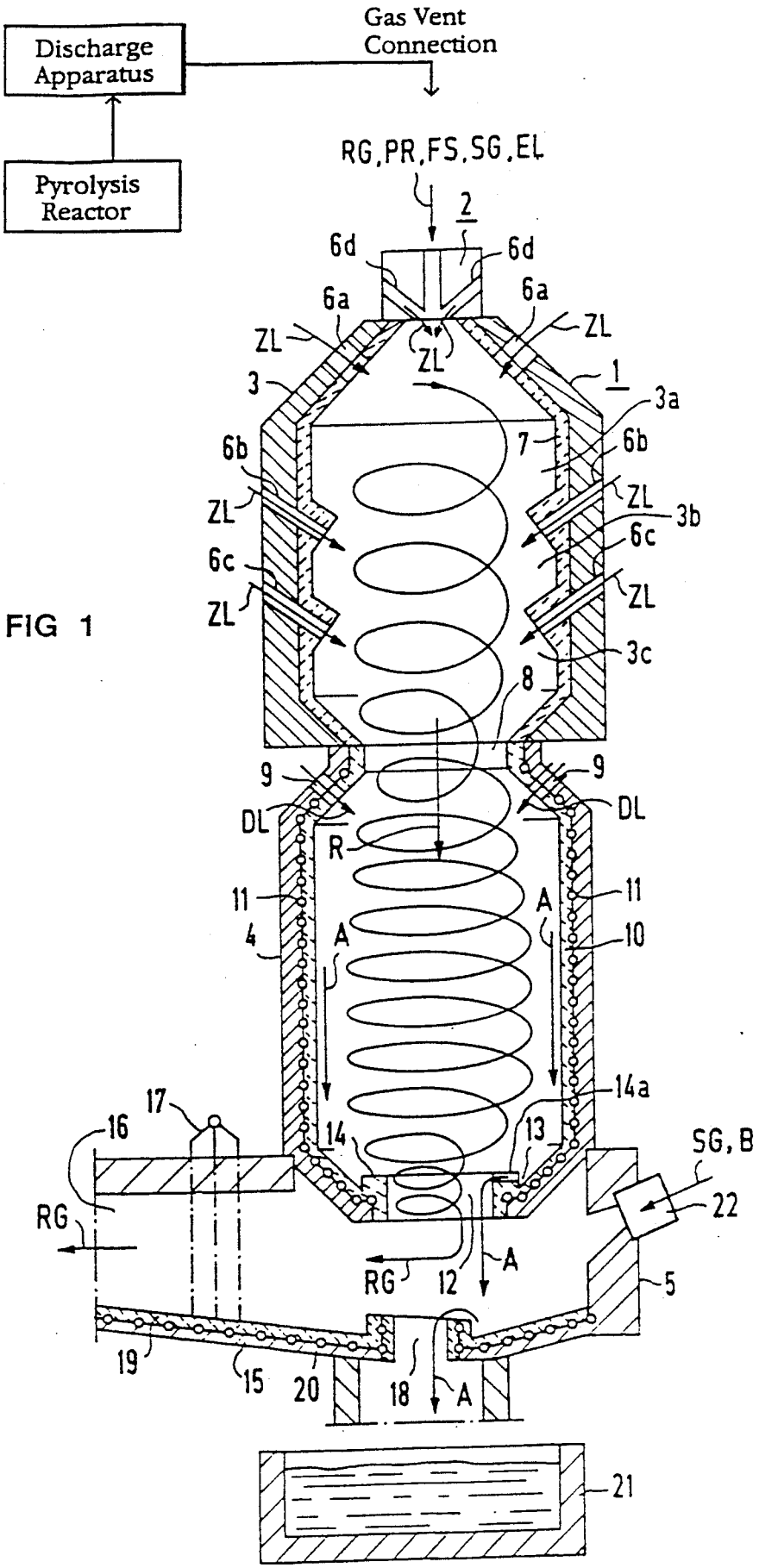
FIG. 1 is a fragmentary, diagrammatic, longitudinal-sectional view of a combustion chamber having a primary chamber being subdivided into partial combustion chambers.

Referring now to the figures of the drawing in detail and first, particularly, to FIG. 1 thereof, there is seen a combustion chamber 1 which is equipped with a burner 2 and is constructed in three parts. A primary chamber 3, a secondary chamber 4 and an ash discharge chamber 5 are disposed in series with one another. The burner 2 is assigned to the primary chamber 3. The primary chamber 3 includes three partial combustion chambers 3*a*, 3*b* and 3*c* disposed one after the other. However, the primary chamber 3 may also be constructed in one part. An at least partially combustible material, which may be pyrolysis residue PR and incompletely burned gas SG from a low-temperature carbonization incineration plant, reaches the primary chamber 3 through the burner 2. A first air flow EL, or primary air, also reaches the primary chamber 3 through the burner 2. The primary chamber 3 has inlets 6*a*, 6*b*, 6*c* and 6*d* distributed over the length thereof for a second air flow ZL or secondary air. At least one inlet 6*a*, 6*b* and 6*c* is associated with each partial combustion chamber 3*a*, 3*b* and 3*c*. At least one further inlet 6*d* may be located in the burner 2. Through the use of a tangential disposition of at least some of the inlets 6*a–d*, eddies are generated in the medium flowing in the primary chamber 3, which bring about good mixing of the medium. A weak spin is also generated in the primary chamber 3, which is propagated into the secondary chamber 4. The delivery of air into the primary chamber 3 is dimensioned in such a way that only a substoichiometric combustion takes place there. The temperature remains below the ash softening point, so that fluid ash A or clinker is not produced. A simple lining 7 of the primary chamber 3, for instance with relatively inexpensive bricks, is therefore sufficient.

The primary chamber 3 communicates directly with the secondary chamber 4 through an outlet 8, which may be constructed with or without drawing or necking in. In the region of the secondary chamber 4 that is oriented toward the primary chamber 3, there is at least one inlet 9 for a third air flow DL, or tertiary air. The air flow DL is dimensioned in such a way that complete combustion of residue R fed from the primary chamber 3 takes place in the secondary chamber 4. This combustion occurs at a temperature above the ash softening point, so that fluid ash A or clinker is produced. Like the inlets 6*a–d* for the second air flow ZL, the inlets 9 for the third air flow DL are aligned obliquely, or in other words with a tangential component relative to the wall of the combustion chamber 1. This produces a spin in the residue R located in the secondary chamber 4, by means of which fluid ash A or clinker is deposited on the inner surface of the secondary chamber 4. There the fluid ash A flows downward. In order to prevent damage, the inner wall surfaces of the secondary chamber 4 are provided with a layer 10 of bricks or tamping clay. In order to ensure that less-expensive material will suffice for the layer 10 of the secondary chamber 4, cooling conduits 11 are located in the walls of the secondary chamber 4, and a coolant, in particular water or air, flows in the conduits 11. As a result of the continuous cooling, the walls of the secondary chamber 4 are attacked little if at all by the fluid ash A, because a solid clinker layer forms between the fluid ash layer and the cooled wall, as a result of the cooling.

The secondary chamber 4 is adjoined through a narrow outlet 12 by the ash discharge chamber 5. The fluid ash A or clinker reaches the inside of the ash discharge chamber 5 through an annular channel 13, which surrounds the outlet 12 and is divided from it by an annular bead 14. The bead 14 has a minimum height at a predetermined point with respect to an imaginary horizontal plane. This forms a drain point 14*a*. Liquid ash A that flows downward along the walls of the secondary chamber 4 initially collects in the channel 13 and then spills over the bead 14 at its lowermost point, namely at the drain point 14*a*. Due to the accumulation of fluid ash A upstream of the outlet into the ash discharge chamber 5, a uniform, continuous ash stream is produced. Since the outlet 12 is narrow, flue gas RG reaches the ash discharge chamber 5 at high speed at that location. The initially downwardly directed flow of flue gas is diverted to a bottom 15 of the ash discharge chamber 5. The bottom 15 in this case acts like an impact plate. Ash particles are thus precipitated out of the flue gas RG.

The ash discharge chamber 5 has a flue gas vent opening 16, through which the flue gas RG is diverted. If needed, an ash catcher grate 17 that retains further ash particles is located upstream of the flue gas vent opening 16. In order to provide for removal of the liquid ash A or clinker, an ash outlet hole 18 is formed in the ash discharge chamber 5. The ash outlet hole 18 is swept and heated by hot flue gas RG, so that ash A or clinker cannot solidify in the ash outlet hole 18. As a result, the ash outlet hole 18 cannot become clogged.

The ash discharge chamber 5 is wider than the outlet 12 of the secondary chamber 4. Accordingly, fluid ash A or clinker can not reach the side walls of the ash discharge chamber 5, so that these walls need not be made of expensive resistant material. The bottom 15 of the ash discharge chamber 5, similar to the walls of the secondary chamber 4, is provided with a layer 19 of tamping clay or bricks and often includes cooling conduits 20.

Cooling conduits may also be present in the side walls. As a result of the cooling, a solid layer of clinker that protects the bottom of the ash discharge chamber 5 against erosion, forms on the bottom 15 of the ash discharge chamber 5 during the course of operation of the combustion chamber 1. The fluid ash A flows over this solid clinker layer, which serves as a heat insulation layer, to the ash outlet hole 18, and from there it reaches a water tank 21, where it breaks into granular pieces. The lowermost point of the annular bead 14 around the outlet 12, or in other words the drain point 14*a* from the secondary chamber 4, is located at a position that is spaced apart from the flue gas vent opening 16 by the maximum distance. This assures that fluid ash A and flue gas RG do not intersect in the ash discharge chamber 5, which would cause turbulence of the flue gas RG and lead to the entrainment of fluid ash in the flue gases. If necessary in order to keep the fluid ash A fluid in the ash discharge chamber 5, a reheating burner 22 is placed in the ash discharge chamber 5 that can be fed with either an outside fuel B or with incompletely burned gas SG from a low-temperature incinerator system. Both flue gas FS that had previously been filtered out of the flue gas RG and flue gas RG can be fed back into the combustion chamber 1.

Figure 2:
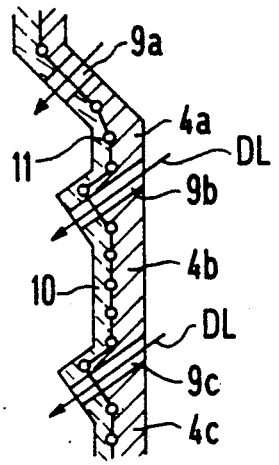
FIG. 2 is a fragmentary, longitudinal-sectional view of a wall of a secondary chamber being subdivided into partial combustion chambers.

The combustion chamber of FIG. 2 differs from the combustion chamber 1 of FIG. 1 only in that in addition to the primary chamber 3, the secondary chamber 4 is also subdivided into partial combustion chambers 4*a*, 4*b*, 4*c*. One inlet 9*a*, 9*b* and 9*c* is associated with each respective partial combustion chamber 4*a*, 4*b* and 4*c*. This effects good mixing of the medium in the secondary chamber 4. The weak spin already generated in the primary chamber 3 is reinforced in the secondary chamber 4 as well. The delivery of air and thus combustion can also be well controlled.

Figure 3:
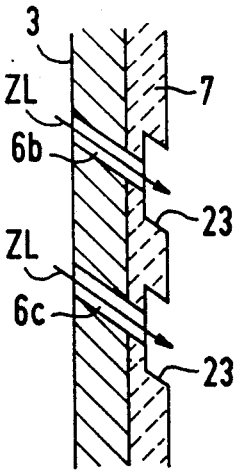
FIG. 3 is a fragmentary, longitudinal-sectional view of a wall of a combustion chamber having indentations comprising air supply devices.

The air inlets 6*b*, 6*c* in the primary chamber 3 can, for instance, be constructed in such a way that the inner wall surface of the primary chamber 3 has indentations 23 as shown in FIG. 3, with the inlets 6*b*, 6*c* discharging into the inside of these indentations 23. The inlets 6*b*, 6*c* are then located in a protected position. Corresponding indentations for receiving the inlets 9*b*, 9*c* can also be provided in the inner wall surface of the secondary chamber 4.

Figure 4:
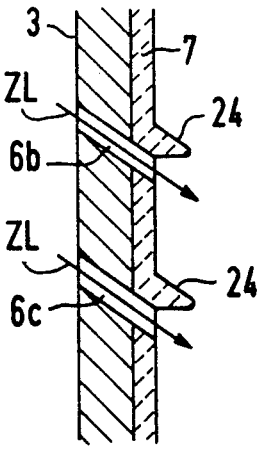
FIG. 4 is a fragmentary, longitudinal-sectional view of a wall of a combustion chamber having air supply devices and eave-like protrusions disposed above them.

As shown in FIG. 4, an eave-like protrusion 24 may be disposed on the inner wall surface of the primary chamber 3 above a respective inlet 6*b*, 6*c*, in order to protect it. A corresponding eave-like protrusion may also be disposed above an inlet 9*b*, 9*c* on the inner wall surface of the secondary chamber 4.

In the combustion chamber 1, fuels, and in particular pyrolysis residue PR and incompletely burned gas SG, which originate in a low-temperature carbonization drum, can be combusted completely and converted into flue gas RG and fluid ash A or clinker, without requiring expensive, complicated coatings of the combustion chamber 1 and without requiring frequent maintenance and repair to the combustion chamber 1.

We claim:

1. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having a wall and an inlet for a second air flow disposed in said primary chamber and aligned obliquely relative to said wall of said primary chamber; and said secondary chamber having an inlet for conducting a third air flow and said secondary chamber having walls and a material lining said walls being resistant to fluid clinker.

2. Combustion chamber according to claim 1, wherein said ash discharge chamber has a bottom with an ash outlet hole formed therein.

3. Combustion chamber according to claim 1, wherein said ash discharge chamber has a flue gas vent opening formed therein.

4. Combustion chamber according to claim 1, wherein said secondary chamber has walls and means for cooling said walls.

5. Combustion chamber according to claim 1, including a farther inlet for the second air flow disposed in said burner.

6. Combustion chamber according to claim 1, wherein said primary chamber has an upper portion, and said inlet for the second air flow is disposed at said upper portion laterally of said burner.

7. Combustion chamber according to claim 1, including other inlets for the second air flow, a plurality of said inlets for the second air flow being distributed over the height of said primary chamber.

8. Combustion chamber according to claim 1, including other inlets for the second air flow and other inlets for the third air flow, a plurality of said inlets for the second air flow and a plurality of said inlets for the third air flow being disposed in parallel planes one under the other.

9. Combustion chamber according to claim 1, including other inlets for the second air flow, a plurality of said inlets for the second air flow being disposed in parallel planes one under the other.

10. Combustion chamber according to claim 1, including other inlets for the third air flow, a plurality of said inlets for the third air flow being disposed in parallel planes one under the other.

11. Combustion chamber according to claim 1, wherein said primary chamber is subdivided into partial combustion chambers beinq connected in series with one another.

12. Combustion chamber according to claim 11, including other inlets for the second air flow, said partial combustion chambers having upper portions, and said inlets for the second air flow being disposed in said upper portions of each of said partial combustion chambers.

13. Combustion chamber according to claim 1, wherein said secondary chamber is subdivided into partial combustion chambers being connected in series with one another.

14. Combustion chamber according to claim 13, including other inlets for the third air flow, said partial combustion chambers having upper portions, and said inlets for the third air flow being disposed in said upper portions of each of said partial combustion chambers.

15. Combustion chamber according to claim 1, wherein said secondary chamber has walls with inner surfaces and bricks covering said inner surfaces.

16. Combustion chamber according to claim 1, wherein said secondary chamber has walls with inner surfaces and tamping clay covering said inner surfaces.

17. Combustion chamber according to claim 1, wherein said secondary chamber has walls with inner surfaces and cooling conduits disposed in said walls for receiving a coolant.

18. Combustion chamber according to claim 1, including means for supplying fly ash to one of said chambers.

19. Combustion chamber according to claim 1, wherein said ash discharge chamber has a horizontally extending bottom.

20. Combustion chamber according to claim 1, including a reheating burner disposed in said ash discharge chamber.

21. In a system for thermal trash disposal having a pyrolysis reactor for converting trash into incompletely burned gas and essentially non-volatile pyrolysis residue, and a discharge apparatus being connected to the pyrolysis reactor for the non-volatile pyrolysis residue and having an incompletely burned gas vent connection for venting incompletely burned gas, a combustion chamber for receiving the incompletely burned gas and prepared pyrolysis residue, the combustion chamber comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow for substoichiometric combustion of a substance to be combusted at a temperature below an ash softening point and without clinker flow; and said secondary chamber having an inlet for conducting a third air flow for brief, intensive, complete combustion of the substance discharged from said primary chamber with clinker flow, and said secondary chamber having walls and a material lining said walls being resistant to fluid clinker.

22. Process for combusting a substance being at least partially formed of combustible material, which comprises feeding an air flow to the substance for substoichiometrically combusting the substance at a temperature below an ash softening point without clinker flow but with formation of a residue; and subsequently admixing a further air flow with the residue of the substoichiometric combustion for completely combusting the residue and forming flue gas and flowing ash.

23. Process according to claim 22, which comprises forming prepared pyrolysis residue and incompletely burned gas as the at least partially combustible material by low-temperature carbonization of trash.

24. Process according to claim 22, which comprises generating an eddy in at least one of the substance and the residue.

25. Process according to claim 22, which comprises admixing fly ash with one of the substance, the residue and the flowing ash.

26. Process according to claim 22, which comprises heating the ash after formation thereof.

27. Process according to claim 22, which comprises feeding the flue gas back into at least one of the substance and the residue of the substoichiometric combustion.

28. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having a wall and a plurality of inlets for a second air flow distributed over the height of said primary chamber and being aligned obliquely relative to said wall of said primary chamber;

and said secondary chamber having an inlet for conducting a third air flow and said secondary chamber having walls and a material lining said walls being resistant to fluid clinker.

29. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker;

said primary chamber and said secondary chamber having walls, at least one of said walls having an indentation formed therein, and one of said inlets discharging in said indentation.

30. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and at least one of said primary and secondary chambers having an interior with an eave-like protrusion disposed above one of said inlets.

31. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow, said secondary chamber having a wall and an inlet for a third air flow disposed in said secondary chamber and aligned obliquely relative to said wall of said secondary chamber and said secondary chamber having walls and a material lining said walls being resistant to fluid clinker.

32. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow, said secondary chamber having a wall and a plurality of inlets for a third air flow disposed in said secondary chamber and aligned obliquely relative to said wall of said secondary chamber; and said secondary chamber having an inlet for conducting the third air flow and said secondary chamber having walls and a material lining said walls being resistant to fluid clinker.

33. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow, and said secondary chamber having walls and a material lining said walls being resistant to fluid clinker; and said secondary chamber having an outlet with a given width leading to said ash discharge chamber, said ash discharge chamber being wider than said given width and having a bottom and side walls, and only said bottom but not said side walls of said ash discharge chamber being coated.

34. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said secondary chamber having an outlet with a given width leading to said ash discharge chamber, said ash discharge chamber being wider than said given width and having a bottom and side walls, and only said bottom but not said side walls of said ash discharge chamber having cooling means.

35. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said secondary chamber having an outlet with a given width leading to said ash discharge chamber, said ash discharge chamber being wider than said given width and having a bottom and side walls, and only said bottom but not said side walls of said ash discharge chamber being coated and having cooling means.

36. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said ash discharge chamber having a bottom with a layer of bricks disposed thereon.

37. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said ash discharge chamber having a bottom with a layer of tamping clay disposed thereon.

38. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said ash discharge chamber having a bottom with cooling conduits for receiving a coolant.

39. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said ash discharge chamber having a bottom with an ash outlet hole formed therein and a flue gas vent opening formed therein, said secondary chamber having an outlet leading into said ash discharge chamber with a side facing away from said flue gas vent opening, and said secondary chamber having an annular bead in said secondary chamber surrounding said outlet and having a drain point at said side facing away from said flue gas vent opening.

40. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and said ash discharge chamber having a bottom with an ash outlet hole formed therein and having a flue gas vent opening formed therein and an ash catcher grate disposed in said flue gas vent opening.

41. Combustion chamber for combusting a substance, comprising:

a burner; and at least three successively disposed parts including a primary chamber, a secondary chamber and an ash discharge chamber;

said burner being associated with and conducting a first air flow to said primary chamber;

said primary chamber having an inlet for conducting a second air flow and said secondary chamber having an inlet for conducting a third air flow and said secondary chamber having walls and a material lining said walls being resistant to fluid clinker; and a reheating burner disposed in said ash discharge chamber, including means for deeding incompletely burned gas to said reheating burner.

* * * * *